US005435109A

United States Patent [19]

Kim

[11] Patent Number: 5,435,109

[45] Date of Patent: Jul. 25, 1995

[54] FABRICATED HOUSE PANEL

[76] Inventor: Kyung-ju Kim, 8-505, Dongwon Apt., Daechi-dong, Kangnam-gu, Seoul, Rep. of Korea

[21] Appl. No.: 216,320

[22] Filed: Mar. 23, 1994

[30] Foreign Application Priority Data

Mar. 23, 1993 [KR] Rep. of Korea ..... 1993-4479

[51] Int. Cl.[6] ..... E04B 1/38

[52] U.S. Cl. ..... 52/585.1; 52/127.12; 52/582.2

[58] Field of Search ..... 52/127.7, 127.12, 582.2, 52/585.1

[56] References Cited

U.S. PATENT DOCUMENTS

| | | | |
|---|---|---|---|
| 2,647,287 | 8/1953 | Jones | 52/582.2 |
| 3,264,019 | 8/1966 | Houvener et al. | 52/127.12 |
| 4,299,067 | 11/1981 | Bertschi | 52/127.12 |
| 4,457,117 | 7/1984 | Leiher et al. | 52/127.12 X |

FOREIGN PATENT DOCUMENTS

| | | | |
|---|---|---|---|
| 0200935 | 8/1990 | Japan | 52/127.7 |

*Primary Examiner*—Carl D. Friedman
*Assistant Examiner*—Christopher Todd Kent
*Attorney, Agent, or Firm*—Leydig, Voit & Mayer

[57] ABSTRACT

A fabricated house panel improved so as to make the fabrication convenient, has a screw shaft projectable from the surface where two panels are put together, and a bushing member couplable by the screw shaft, with the coupling parts being provided inside of the panel, to thereby maintain the fine outer appearance of the panel. Further, the panels are coupled by a screw shaft extending along the coupling direction of the panels, which results in the increase of the coupling power and the resistance against an external force applied from a side direction.

12 Claims, 6 Drawing Sheets

FABRICATED HOUSE PANEL

BACKGROUND OF THE INVENTION

The present invention relates to a fabricated house panel, and more particularly, to a fabricated house panel which includes a bushing having a female screw in one side and a screw pole to be coupled with the bushing of an adjacent panel in another side.

In general, ceilings or walls of a fabricated house are composed of a variety of panel units. The panels also include coupling parts for interlocking the panels together. FIG.1 schematically shows conventional panels including coupling parts. Locking pins 3 and 4 are respectively installed at one edge of respective panels 1 and 2 and crescent shaped hinge supported lockers 5 wherein a ratchet surface 5' is formed are installed at another edge. Panels 1 and 2 are fabricated together by locking locker 5 of panel 2 to locking pin 3 of adjacent panel 1.

However, the above-mentioned panel for a fabricated house has a protruding locker 5 and locking pin 3 on the front surfaces of panels 1 and 2. Therefore, the outer appearance of the panels is not so fine and locker 5 and locking pin 3 may be damaged during conveyance. Moreover, since the panels are locked by hinge supported locker 5, the panels have a weak resistance against an external force applied from a side direction.

Further, additional coupling parts are needed in order to couple panels 1 and 2 with a corner pillar, and the coupling with the pillar is inconvenient.

SUMMARY OF THE INVENTION

It is an object of the present invention to provide a fabricated house panel whose outer appearance is fine and whose coupling parts will not be damaged during conveyance or movement, where the coupling parts provided in the panel are not exposed to the outside.

It is another object of the present invention to provide a fabricated house panel whose structure is enhanced so as to resist external force applied from a side direction when two adjacent panels are coupled.

It is still another object of the present invention to provide a fabricated house panel which is improved so that the adjacent two panels are conveniently coupled.

It is further another object of the present invention to provide a fabricated house panel which is improved so that the panel can be simply coupled with a corner pillar.

There is provided a fabricated house panel comprising:

a board member having a hole formed in the front face thereof;

a bushing member having a female screw and which is installed in an internal portion of one side of the member board and whose one end is installed to be exposed to one side of the board member;

a hollow cylinder having one end provided with a female screw and installed in an internal portion of another side of the board member so as to be exposed to another side of the board member;

a movable coupling member including a screw shaft for screwing into a female thread of the hollow cylinder so as to protrude to the outside of the board member and also including a movable member integratedly connected with the screw shaft so as to be rotatably movable inside of the hollow cylinder; and a static tightening member including a static member inserted into the movable member so as to rotate together therewith and also including a gear integrally connected with the static member and which is supported to be slipped into one end of the hollow cylinder and exposed to the outside via the hole of the board member.

There is also provided a fabricated house panel of another embodiment of the present invention, comprising:

a board member having a hole formed in a front face thereof;

a bushing member having a female screw and which is installed in an internal portion of one side of the board member and having one end installed to be exposed to one side of the board member;

a hollow cylinder having at one end having a female screw and installed in an internal portion of another side of the board member so as to be exposed to another side of the board member;

a movable coupling member comprising a screw shaft inserted into a female screw of the hollow cylinder so as to protrude to the outside of the board member and also comprising a moving member integratedly coupled with the screw pole so as to be movable inside of the hollow cylinder;

a static tightening member comprising a static member coupled with the moving member so as to rotate together and also comprising a gear integratedly coupled with the static member and which is supported so as to be slipped to one end of the hollow cylinder; and a tightening member comprising a gear which gears into a gear of the static tightening member and a rotating member coaxially fabricated with the gear and fixed into a hole of the board member.

According to a characteristic of the present invention, panels are fabricated by means of screwing the screw shaft prepared in one panel into the bushing member prepared in the adjacent panel. Coupling elements such as a bushing member and screw shaft are installed inside of the panel, to thereby prevent damage during conveyance. Moreover, the outer appearance of the panel is fine, and resistance against the outer force applied externally from a side direction can be increased since the panels are coupled in a lengthwise direction by a screw shaft.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

The present invention will be explained in more detail with reference to the attached drawings.

Figure 1:
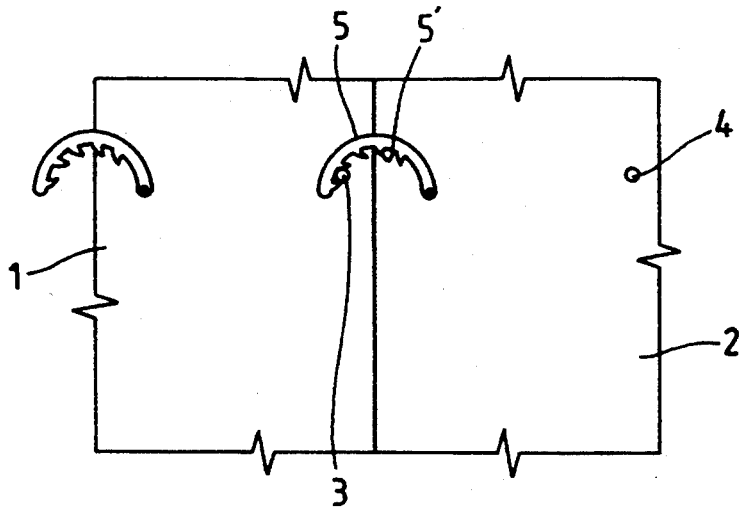
FIG.1 (PRIOR ART)
FIG. 1 is a front view showing a conventional fabricated house panel.
Figure 2:
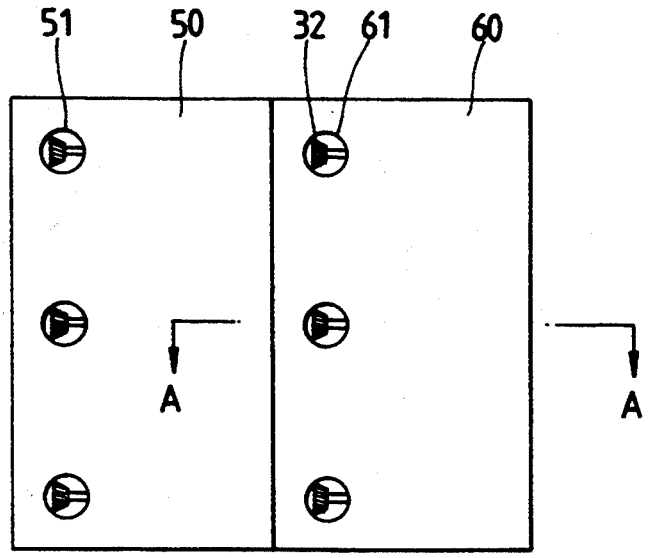
FIG. 2 is a front view showing a fabricated house panel according to the present invention.
Figure 3:
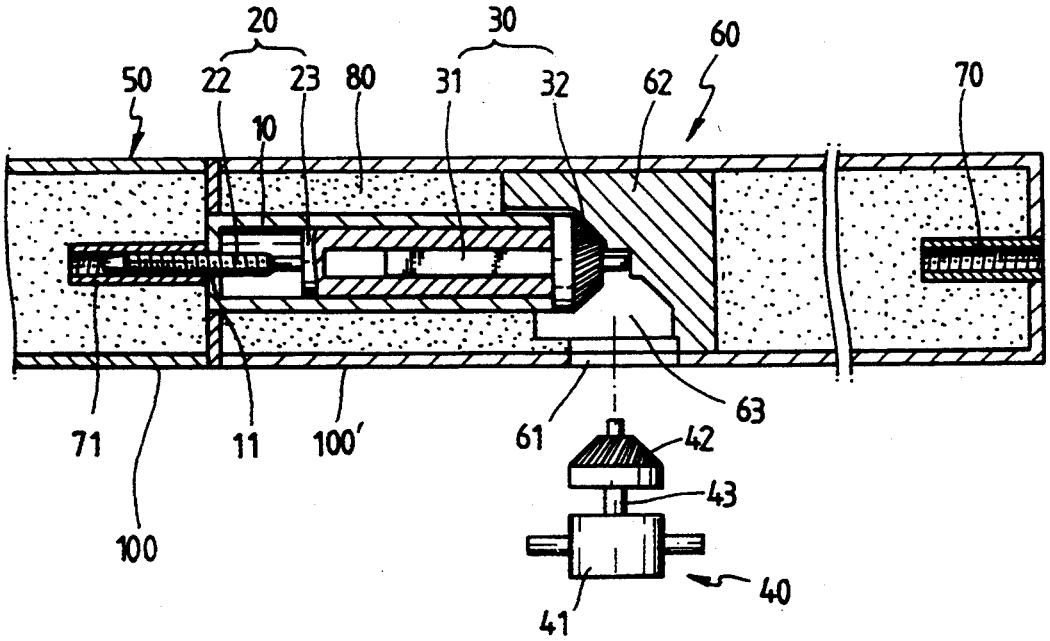
FIG. 3 is a cross-sectioned view taken along line A—A of FIG. 2.
Figure 4:
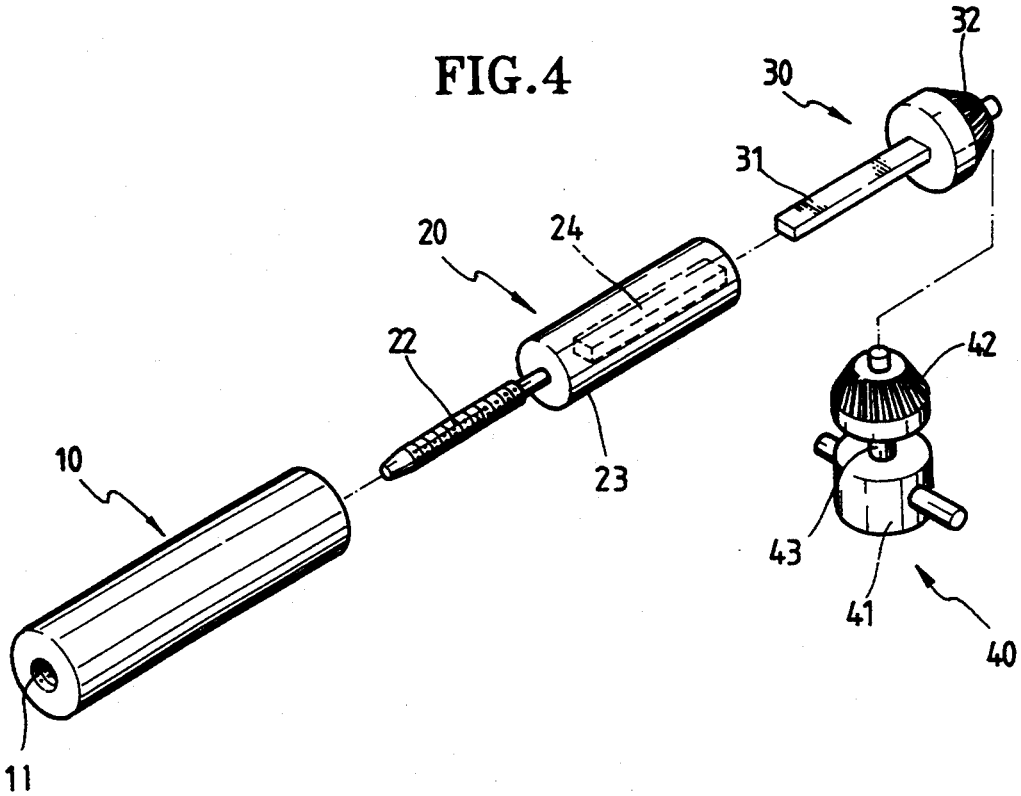
FIG. 4 is an exploded perspective view showing the coupling parts of a panel according to the present invention.

Referring to FIG. 2 to FIG. 4, a plurality (only one is shown) of bushing members 70 wherein a female screw 71 is formed are provided inside of a board member 100 at predetermined intervals. Bushing member 70 is installed so that one end thereof lies flush with the plane of one side edge of board member 100.

Inside of the adjacent board member 100' a hollow cylinder 10 in one end of which is formed a female screw 11 is installed in the location where hollow cylinder 10 faces opposing bushing member 70 of board member 100 in alignment therewith. At this time, hollow cylinder 10 is installed so that the end portion thereof having female screw 11 lies flush with the plane of the one edge surface of board member 100'.

A movable coupling member 20 is integrally provided with a threaded screw shaft 22 and has a cylindrical movable member portion 23 which can move within hollow cylinder 10. Movable coupling member 20 and screw shaft 22 which can screw into female screw 11, are coupled inside of hollow cylinder 10. Additionally, a static tightening member 30 which rotates in a longitudinally stationary state so as to move movable coupling member 20 in the proceeding direction of screw shaft 22, is installed inside of board member 100. Static tightening member 30 includes a static member 31 which is coupled with movable member 23 so as to be rotated together therewith and a bevel gear 32 integrally coupled with static member 31 and supported with a shoulder which can be slipped to an end portion of hollow cylinder 10.

A spacer 62 maintains hollow cylinder 10 with movable coupling member 20 and static tightening member 30 installed therein at a predetermined location inside of board member 100. In addition, an access hole 61 is formed in the front surface of board member 100 at the location which corresponds to gear 32 of static tightening member 30. Here, an opening 63 is formed between hole 61 of board member 100 and gear 32 of static tightening member 30. An adiabatic material 80, for example, polyurethane, fills up an internal portion of board member 100 except at the location of movable coupling member 20, static tightening member 30, spacer 62 and opening 63.

Here, as shown in FIG.4, a long coupling hole 24 is formed in movable member 23 of movable coupling member 20 along the proceeding direction of screw shaft 22. Static member 31 of static tightening member 30 is formed to have a section surface shaped to correspond to that of coupling hole 24 so that static member 31 and movable member 23 can rotate together.

Figure 5:
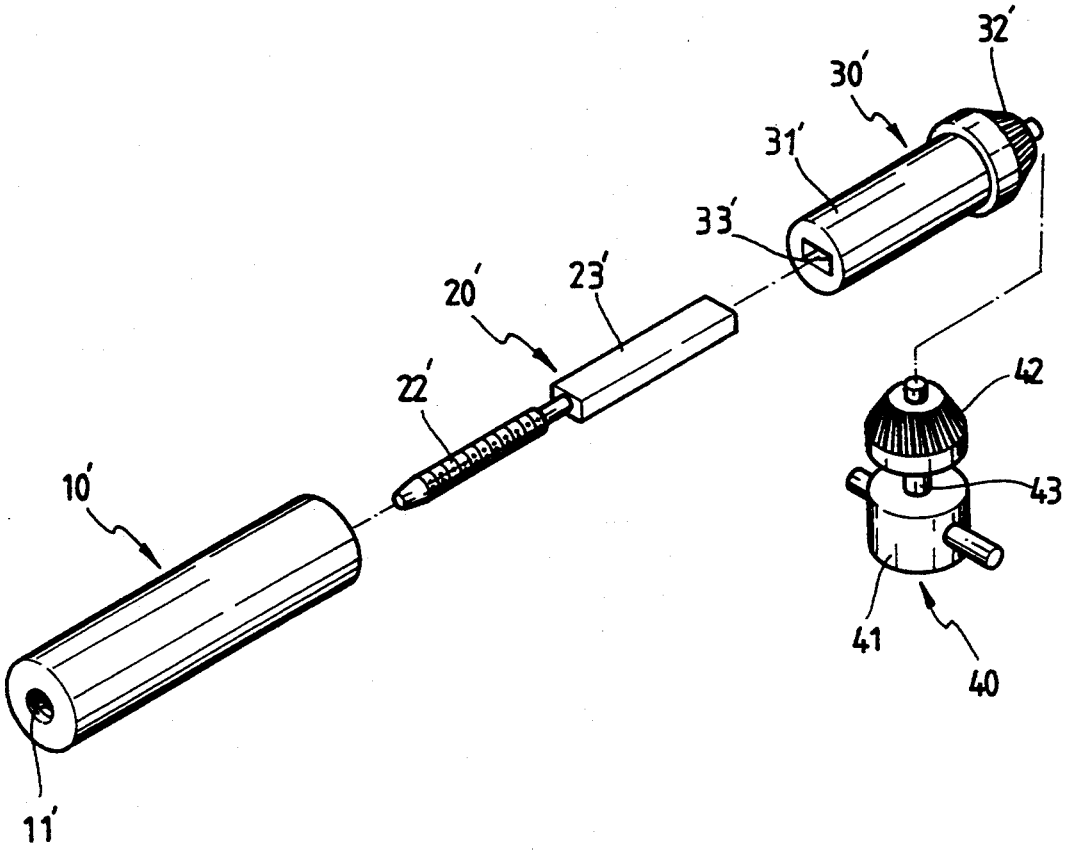
FIG. 5 is an exploded perspective view showing the parts of a panel coupling according to another embodiment of the present invention.

In an alternative embodiment, as shown in FIG. 5, a movable member 23' of movable coupling member 20' is formed to be a tetragonal shaft. A coupling hole 33' into which movable member 23' may be inserted is formed in a static member 31' of static tightening member 30' to thereby enable movable coupling member 20' to be rotated in accordance with the rotation of static tightening member 30'.

Meanwhile, as shown in FIG. 3, the thus-structured fabricated house panels 50 and 60 can be coupled by employing a tightening member 40. Tightening member 40 includes a bevel gear 42 which meshes into gear 32 of static tightening member 30 and a handle 41 connected with gear 42 by an axle 43. Here, bevel gear 42 meshes into bevel gear 32 of static tightening member 30 by inserting tightening member 40 through hole 61 formed in board member 100. Then, handle 41 is rotated to rotate static tightening member 30. At this time, static tightening member 30 rotates in the state where one surface of bevel gear 32 thereof is supported by the end portion of hollow cylinder 10. Movable coupling member 20 rotates according to the rotation of static tightening member 30 and moves by having screw shaft 22 fixed into female screw 11 of hollow cylinder 10. At this time, screw shaft 22 is fixed into bushing member 70 of the adjacent panel 50. Gear 32 of static tightening member 30 and gear 42 of tightening member 40 are formed as bevel gears so that static tightening member 30 can be rotated at the front surface of panels 50 and 60.

Figure 6:
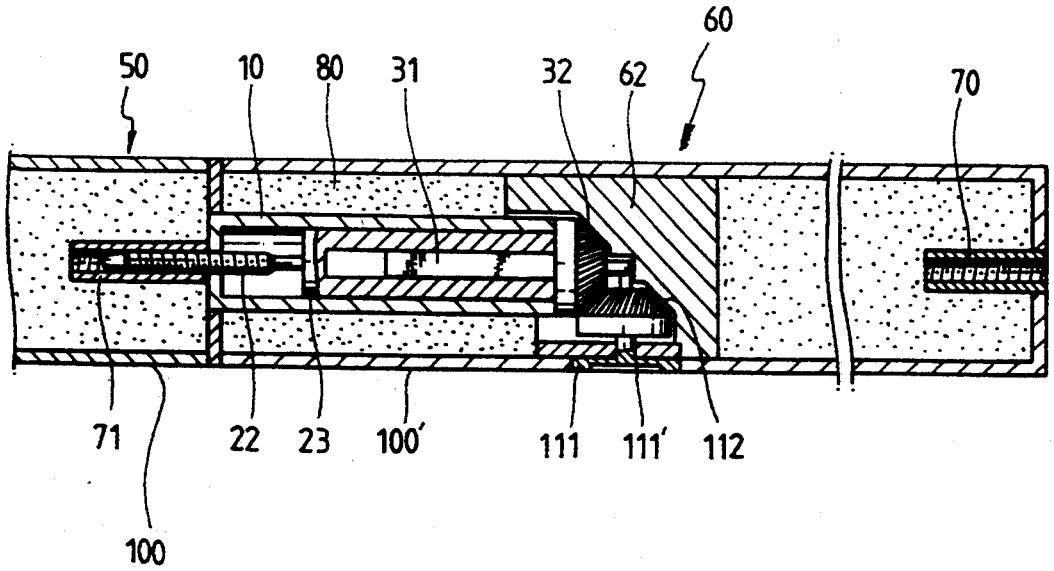
FIG. 6 is a cross-sectional view showing another embodiment of a fabricated house panel of the present invention.
Figure 7:
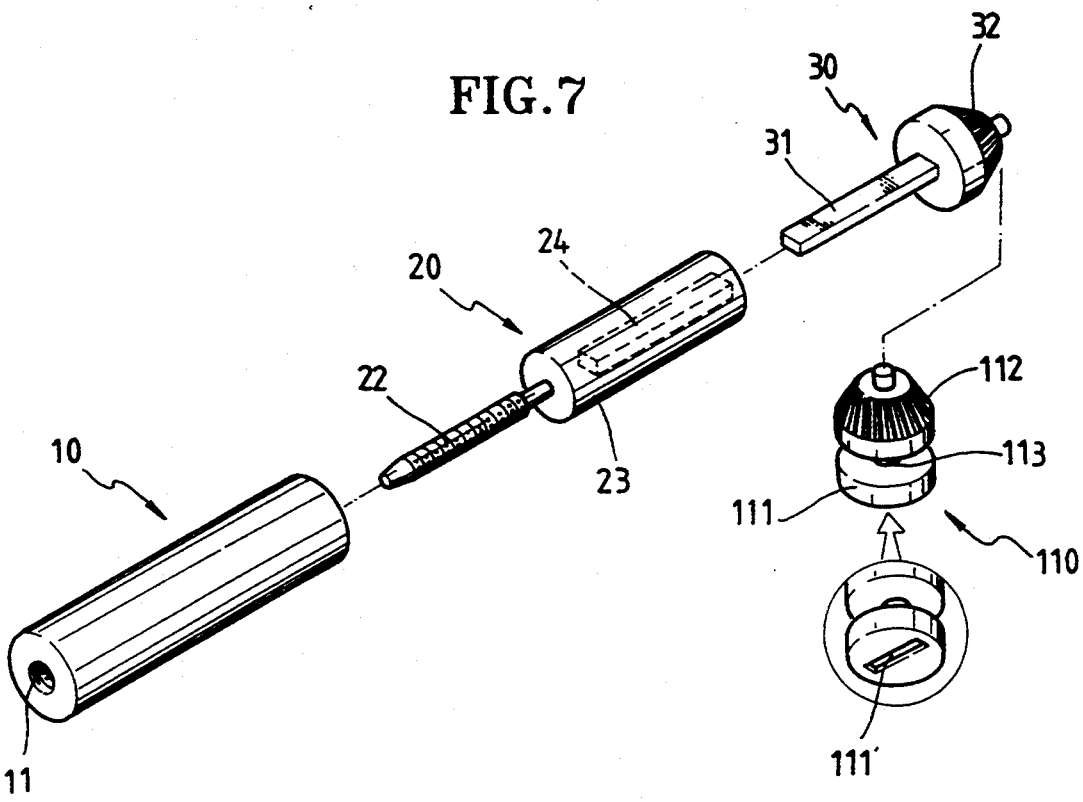
FIG. 7 is an exploded perspective view showing the coupling parts extracted from the panel of FIG. 6.

Meanwhile, FIG.6 and FIG.7 show another embodiment of a fabricated house panel according to the present invention. A detailed explanation of those components which are the same as those of embodiment 1 shown in FIG.2 to FIG.5 will be omitted. That is, bushing member 70, movable coupling member 20, static tightening member 30 and spacer 62 are installed inside of board members 100 and 100' as in embodiment 1. In board member 100, a tightening member 110 is fixed into opening 61. Tightening member 110 includes a bevel gear 112 which meshes into bevel gear 32 of static tightening member 30 and a rotating member 111 which is coaxially mounted with gear 112 by way of a shaft 113. Rotating member 111 is disposed so as to lie flush on the plane of member board 100, and a drive groove 111' is formed therein so that rotating member 111 can be rotated by tools applied thereto, for example, by a driver, etc.

Figure 8:
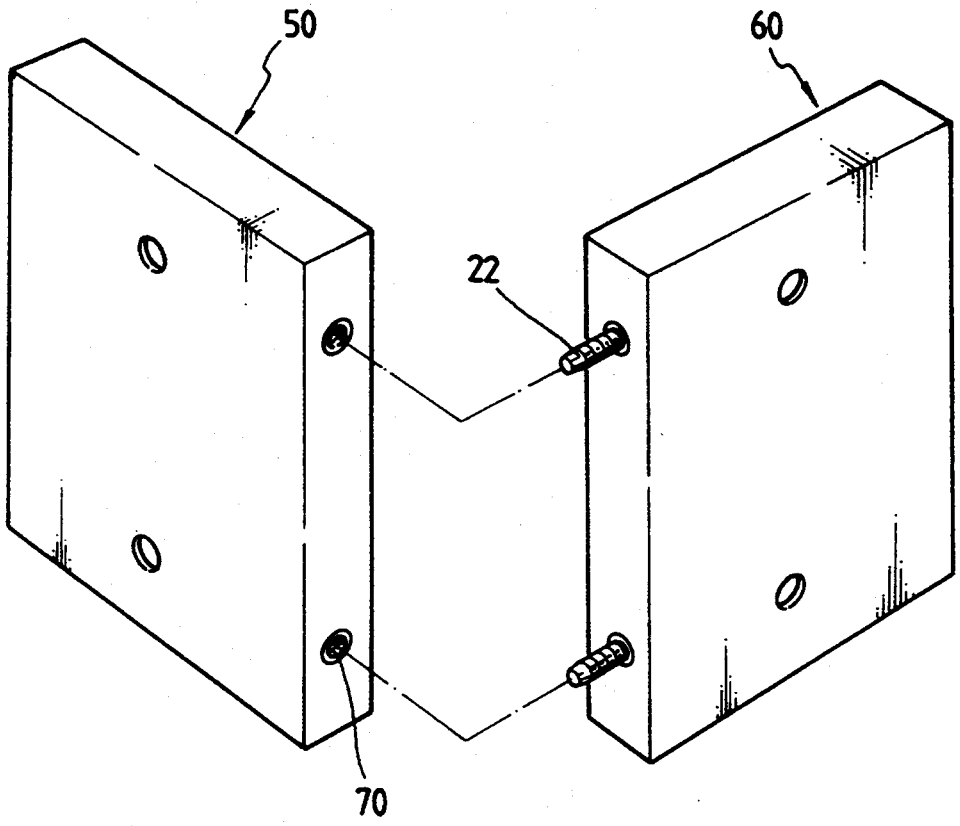
FIG. 8 is an exploded perspective view showing two adjacent panels according to the present invention.

The thus-constructed panels of the present invention are fabricated as follows. First, referring to embodiment 1 shown in FIG.2 to FIG.5, the two panels 50 and 60 are put together as shown in FIG.2 and FIG.8. At this time, bushing members 71 and hollow cylinder 10 respectively installed in the two adjacent panels 50 and 60 face each other as shown in FIG. 3. Then, tightening member 40 is inserted into opening 61 of board member 100 so that gear 32 of static tightening member 30 can mesh into gear 42 of tightening member 40. Thus, static tightening member 30 rotates when tightening member 40 rotates. At this time, static tightening member 30 rotates in a longitudinally static state since one surface of gear 32 is abuttingly supported by hollow cylinder 10. In addition, movable coupling member 20 rotates according to the rotation of static tightening member 30. At this time, screw shaft 22 screws into female screw 11 of hollow cylinder 10, and therefore, movable coupling member 20 rotates and simultaneously moves toward the proceeding longitudinal direction of the screw thread. Thus, screw shaft 22 is coupled to bushing member 71 of the adjacent panel 50 as movable coupling member 20 proceeds. Accordingly, the two adjacent panels 50 and 60 are coupled by screw shaft 22.

Figure 9:
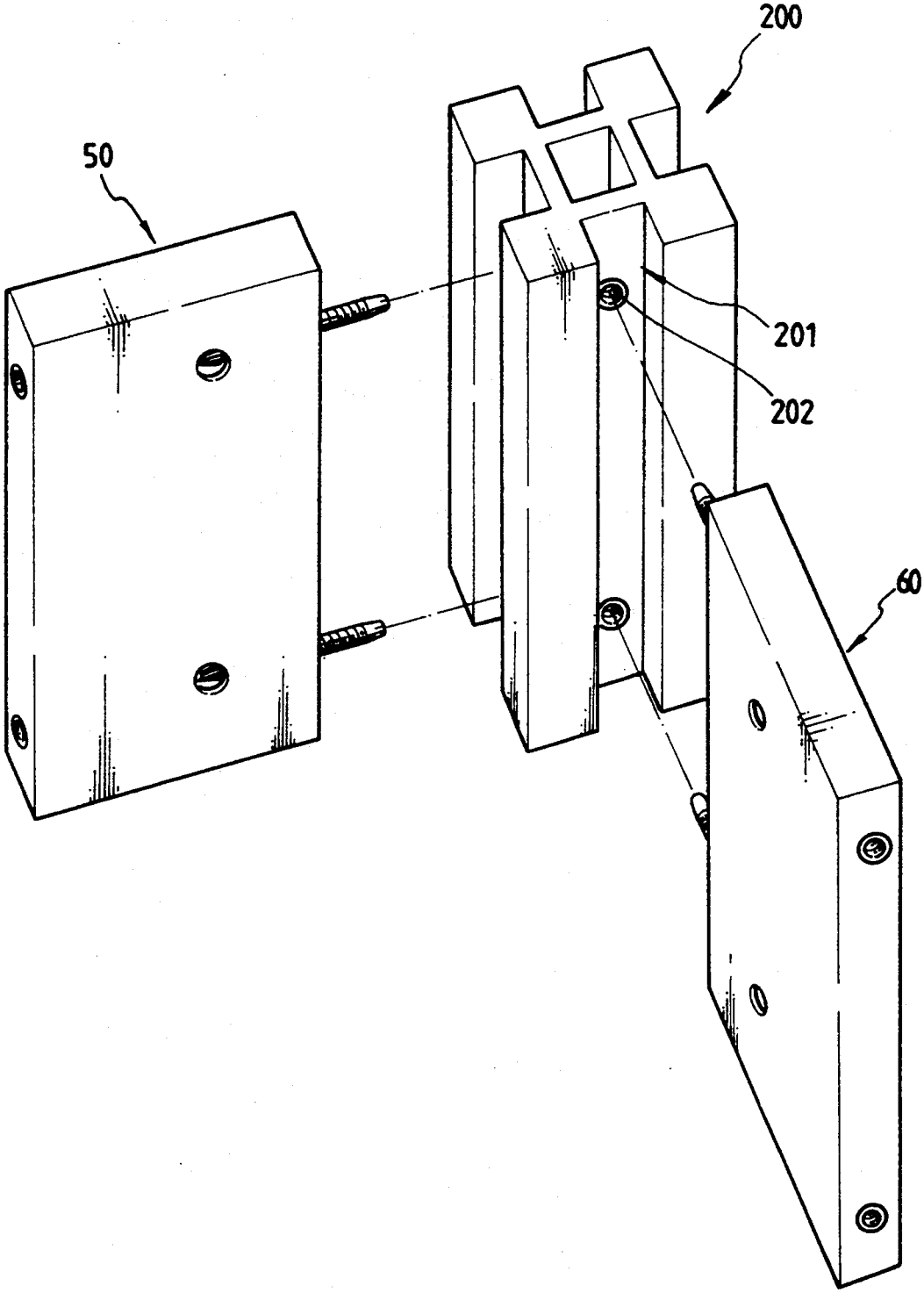
FIG. 9 is an exploded perspective view showing a panel of the present invention being coupled to a pillar.

When panels 50 and 60 are to be coupled at a corner, coupling grooves 201 are formed in a pillar 200 and bushing member 202 is installed in coupling grooves 201 as shown in FIG.9. In addition, panels 50 and 60 are inserted into coupling grooves 201 and movable coupling members 20 are moved and coupled into coupling grooves 201 by using tightening member 40.

When panels 50 and 60 of another embodiment of the present invention shown in FIG.6 and FIG.7 are coupled, two panels 50 and 60 are put together and tightening member 40 is rotated using a driver, etc. At this time, panels 50 and 60 are coupled by screw shaft 22 through the rotation of static tightening member 30 and also through the rotation and movement of movable coupling member 20.

As described above, panels 50 and 60 of a fabricated house of the present invention can be prevented from being damaged during conveyance and the outer appearance is maintained to be fine because the coupling parts such as hollow cylinder 10, bushing members 70 and 71, movable coupling member 20 and static tightening member 30 are installed inside of board member 100.

In addition, since the two panels 50 and 60 are coupled by screw shaft 22, the panel has a stronger resistance against the external force applied from a side direction than the conventional panel which is coupled by a locker installed on one surface of a panel.

Further, panels 50 and 60 can be conveniently coupled with a pillar 200 in a corner.

It should be understood that variations of the preferred embodiment will occur to those skilled in the art. For example, the lengths of screw shaft 22 and bushing members 70 and 71 can be appropriately adjusted depending on the width of panels 50 and 60. Moreover, the shape of the sectional surfaces of movable member 23 of movable coupling member 20 and static member 31 of static tightening member 30 coupled with movable member 23 can be variously formed as polygon, for example, triangle or tetragon. The shapes of the two gears which meshingly gear into each other, i.e., tightening gear 32 of static tightening member 30 and gear 42 of tightening member 40, can be changed without departing from the spirit and scope of the present invention.

What is claimed is:

1. A fabricated house panel comprising:

a board member having a hole formed in a front face thereof;

a bushing member having a female screw therein and provided in an internal portion of one side of said board member and having one end exposed to a side edge of said board member;

a hollow cylinder having an end portion thereof provided with a female screw, and provided in an internal portion of another side edge of said board member so as to be exposed to said another side edge of said board member;

a movable coupling member provided within said hollow cylinder and including a screw shaft arranged to be coupled into the female screw of said hollow cylinder so as to protrude outside of said board member and also including a movable member integrally coupled with the screw shaft so as to move therewith inside of said hollow cylinder; and a static tightening member including a static member inserted into said movable member so as to rotate together therewith and also including a gear integrally connected with the static member and supported to be slipped into one end of said hollow cylinder and exposed to the outside via the hole of said board member.

2. A fabricated house panel according to claim 1, further comprising a spacer provided within said board member for maintaining said hollow cylinder at a predetermined location in the internal portion of said board member.

3. A fabricated house panel according to claim 1, wherein a coupling hole which is elongated towards a proceeding direction of said screw shaft is formed in said movable member, and said static member is formed in a shape that corresponds to a cross-sectional shape of the coupling hole so as to rotate together with said movable member.

4. A fabricated house panel according to claim 1, wherein said movable member is formed as a long square rod shape extending in the proceeding direction of said screw shaft and a coupling hole having a cross-section that corresponds to the shape of the cross-section of said square rod is formed in said static member so as to couple with said square rod.

5. A fabricated house panel according to claim 1, wherein said gear is a bevel gear.

6. A fabricated house panel according to claim 1, wherein an adiabatic material fills up an internal space of said board member except where said bushing member, said hollow cylinder, and said static tightening member are provided.

7. A fabricated house panel comprising:

a board member having a hole formed in a front face thereof;

a bushing member having a female screw and installed in an internal portion of one side of said member board and having one end thereof exposed to one side edge of said board member;

a hollow cylinder having at one end a female screw and being installed in an internal portion of another side of said board member so as to be exposed to another side of said board member;

a movable coupling member provided within said hollow cylinder and including a screw shaft coupled with the female screw of said hollow cylinder so as to protrude to the outside of said board member and also including a movable member integrally coupled with the screw shaft so as to move therewith within said hollow cylinder;

a static tightening member including a static member coupled with the movable member so as to rotate together therewith and also including a first gear integrally coupled with the static member and supported so as to abut an inner end of said hollow cylinder; and a tightening member including a second gear which meshes with said first gear of said static tightening member and a rotating member coaxially formed with the second gear and fixed within a hole provided in said board member.

8. A fabricated house panel according to claim 7, further comprising a spacer provided in said board member which maintains said hollow cylinder at a predetermined location in the internal portion of said board member.

9. A fabricated house panel according to claim 7, wherein a coupling hole which is elongated towards a proceeding direction of said screw shaft is formed in said movable member, and wherein said static member is formed in a shape that corresponds to a cross-sectional shape of the coupling hole so as to rotate together with said movable member.

10. A fabricated house panel according to claim 7, wherein said movable member is formed as a long square rod extending in a proceeding direction of said screw shaft and a coupling hole having a cross-section that corresponds to the cross-section of said square rod is provided in said static member so as to couple with said square rod.

11. A fabricated house panel according to claim 7, wherein said first and second gears are bevel gears.

12. A fabricated house panel according to claim 7, wherein an adiabatic material fills up an internal space of said board member except where said bushing member, said hollow cylinder, and said static tightening member are provided.

* * * * *